United States Patent [19]

Bergquist

[11] Patent Number: 4,765,536

[45] Date of Patent: Aug. 23, 1988

[54] THERMOSTATIC CONTROL VALVE ASSEMBLY FOR FUEL GAS BURNER

[75] Inventor: Frank H. Bergquist, Wheaton, Ill.

[73] Assignee: Eaton Corporation, Cleveland, Ohio

[21] Appl. No.: 38,104

[22] Filed: Apr. 14, 1987

[51] Int. Cl.[4] ..... F23N 1/00

[52] U.S. Cl. ..... 236/15 A; 137/862

[58] Field of Search ..... 236/15 A; 137/862

[56] References Cited

U.S. PATENT DOCUMENTS

| | | | |
|---|---|---|---|
| 3,288,366 | 11/1966 | Fleer | 236/15 A |
| 3,542,290 | 11/1970 | Fleer | 236/15 A |
| 3,861,586 | 1/1975 | Katchka | 236/15 A |

*Primary Examiner*—William E. Wayner

*Attorney, Agent, or Firm*—R. A. Johnston

[57] ABSTRACT

A thermostat assembly for a gas fired oven including an integral control valve having a rotatable tapered valve member with axially spaced valving grooves, separately valving fuel gas flow to the standing pilot and main burner lines from separate inlet ports in a tapered bore in the valve block. In the "OFF" and "PILOT" valve positions, fuel gas is permitted to flow only to the pilot burner line. In the range of "ON" position, fuel gas is permitted to flow to both the main burner and pilot lines. Rotation of valve to any of the "ON" positions varies the setting of a thermostat which responds to ambient temperature to substantially reduce main burner flow when a desired ambient temperature has been reached.

13 Claims, 7 Drawing Sheets

THERMOSTATIC CONTROL VALVE ASSEMBLY FOR FUEL GAS BURNER

BACKGROUND OF THE INVENTION

The present invention relates to valve assemblies for controlling the flow of fuel gas to a burner and particularly, to such valve assemblies for controlling gas flow to cooking ovens, particularly the type of ovens employed in recreational vehicles utilizing liquid petroleum (LP) bottled gas. LP gas burning appliances of the type employed in recreational vehicles typically utilize a standing pilot flame for igniting the main oven burner with a flame sensor disposed to sense presence of the pilot flame for opening a main control valve to permit flow to the main burner only when presence of flame has been detected at the pilot burner. When the main burner has been ignited for cooking purposes, a secondary control valve is employed in the fuel gas line to thereafter control flow to the main burner in order to modulate the temperature in the oven about a desired set temperature for cooking. The secondary valve is typically thermostatically controlled by a fluid pressure sensing element connected to a temperature sensor disposed to sense the ambient temperature in the oven.

Presently, commercially available LP gas ovens for recreational vehicles combine the function of the thermostatically controlled secondary burner valve with a manually operated valve for shutting off all gas to the pilot and main burner or shutting off gas to the main burner, but providing flow to the pilot for igniting the standing pilot upon start-up of the appliance. Heretofore, the commercially available thermostatic control valves for LP gas ovens provided a thermostatic valve assembly which permitted gas to flow to the pilot burner and the main burner ignition valve when the thermostatic shut-off valve was placed in the "PILOT" position. In the event that the main burner ignition valve was defective, and either failed to close in the absence of a standing pilot flame, or closed, but leaked fuel gas flow to the main burner in the closed position, a situation was created wherein, upon setting the thermostatic valve to the PILOT position, unwanted gas could flow prematurely to the main burner; and, upon ignition of the pilot, a condition could exist where there was serious hazard of explosion. Such occurrences have been experienced in field service with LP gas ovens; and, it has thus been desirable to provide a thermostatic gas valve which provided, in the PILOT position, gas flow only to the pilot burner and prevented any gas flow to the main burner control valve.

Heretofore, in order to provide separate valving of gas flow from the LP gas source to the main and pilot burners required separate thermostatically controlled valves. This arrangement has proven to be costly and has required the installation of extra tubing and gas lines within the appliance. It has thus been desired to find a way or means of providing a thermostatic shut-off valve assembly for an LP gas oven in which the gas to the main burner and the gas flow to the pilot burner were both controlled individually and separately by a single manually controllable shut-off valve.

SUMMARY OF THE INVENTION

The present invention provides a combination thermostatically controlled and manually operated pilot and main burner shut-off valve assembly for use with LP gas fuel burners of the type widely used for cooking appliances, particularly those of the type supplied for usage in recreational vehicles. The present invention provides a unique and novel combination shut-off and thermostatically operated main burner control valve having a single dial control for the appliance user to shut-off all gas flow to the appliance, provide gas flow only to the pilot burner or provide gas flow to both the pilot burner and the main burner for initiating ignition of the main burner. Upon main burner ignition, a thermostatically operated control valve is responsive to sensed oven temperature to control gas flow for modulating the oven temperature about a selected setting.

The present invention employs a rotatable tapered valve member received in a correspondingly tapered bore in a valve block with axially spaced separate grooves provided in the rotatable valve member. The axially spaced grooves are disposed adjacent separate gas inlet ports and individually control gas flow from one of the inlet ports to separate outlets for the pilot burner and the line to the main burner ignition valve. Rotation of the tapered vale member to the "OFF" position causes the recesses in the tapered valve member to shut off all gas flow to both of the valve outlets. Rotation of the tapered valve member to the PILOT position provides communication between one gas inlet port and the outlet for the pilot burner only. Rotation of the tapered valve member to the ON position provides communication between the second inlet port and the outlet for the line to the main burner ignition valve while maintaining flow to the pilot burner outlet.

Upon ignition of the main burner, the thermostatic sensing element controls movement of a poppet valve for controlling gas flow to the main burner for modulating the oven about the desired preselected cooking temperature.

The present invention thus provides a manually operated shut-off and thermostatically controlled fuel gas valve for a cooking appliance, particularly one employing LP gas, and provides for separate porting of gas flow to the pilot burner and the main burner on a single rotatable tapered valve member, in such a manner that gas flow is provided only to the pilot burner line in the PILOT position. The present invention thus provides a shut-off and thermostatically controlled gas valve which prevents flow of fuel gas to the main burner ignition valve at the time gas flow is provided to the pilot burner for ignition of the standing pilot flame.

The present invention thus provides a unique and novel combination shut-off valve gas thermostat for use in LP gas burning recreational vehicle ovens and provides separate control of gas flow to the pilot and main burners to provide full main burner shut-off function in the line upstream from the main burner ignition valve, thereby providing a redundant valving function in the main burner line in the event of malfunction or leakage of the main burner ignition valve.

BRIEF DESCRIPTION OF THE DRAWINGS

FIG. 3*b* is a view similar to FIG. 3*a* showing the thermostatically controlled valve in the open position;

DETAILED DESCRIPTION

Figure 1:
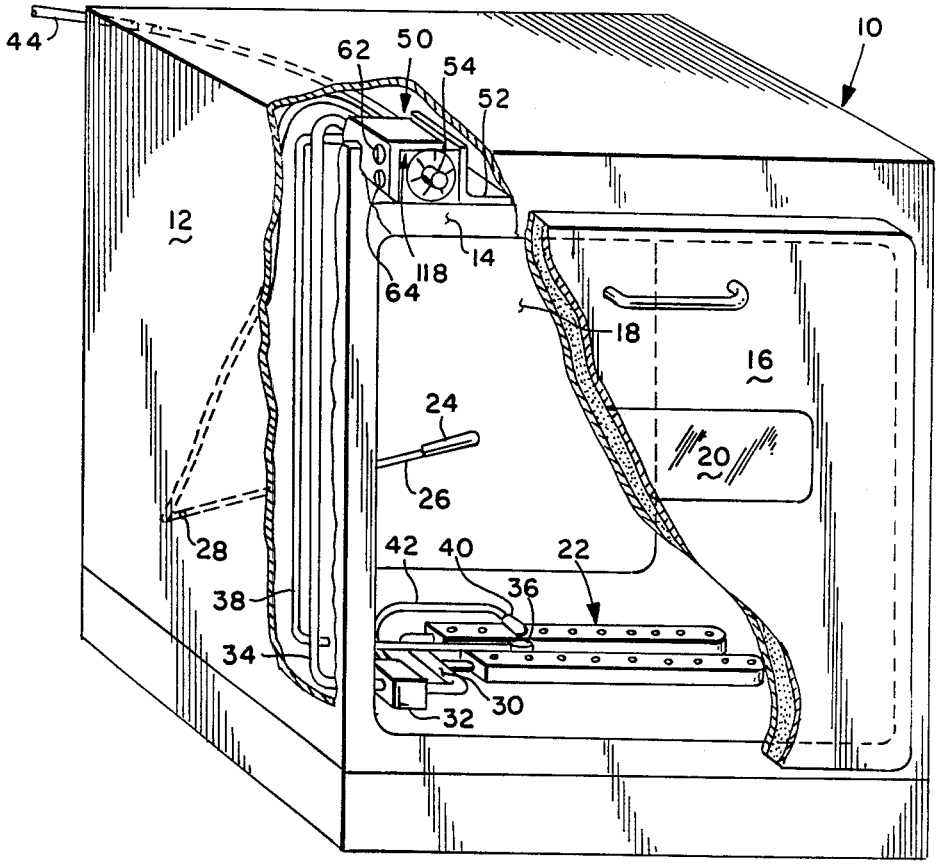
FIG. 1 is a perspective view of a cooking over with portions of the door and cabinet thereof, broken away to expose the valve assembly of the present inventions.

Referring to FIG. 1, a cooking oven indicated generally at 10 of the type employing liquid petroleum LP fuel gas for the burners thereof has an outer casing or housing 12 which surrounds an inner-insulated oven wall 14 which defines the cooking chamber 18. A door 16 is provided and is preferably hinged (not shown) along the bottom edge thereof for providing ready access to the cooking chamber 18, and may employ an inspection or sight glass 20 therethrough if desired.

The oven 10 has disposed in the cooking chamber 18 a burner assembly, indicated generally at 22, which will hereinafter be described in greater detail, and a thermostatic sensing bulb 24 having attached thereto a capillary 26 which extends outwardly through an aperture 28 provided in the wall 14 of the oven.

In a typical application of the oven 10, the burner assembly 22 is supplied by a manifold 30 connected to the outlet of an ignition valve 32 which is supplied by a conduit 34 through the wall 14 of the oven. A pilot burner 36 is disposed closely adjacent the burners in the assembly 22 and is supplied by a pilot supply tube 38 which extends through the inner wall 13 of the oven. Typically, pilot burner 36 has disposed closely adjacent thereto a Mercury filled sensing bulb 40 which has attached thereto a capillary which is connected to the ignition valve 32. As is known in the art, the Mercury vaporizes upon the bulb sensing the presence of pilot flame; and, the expansion of the Mercury vapor is employed for effecting opening of the valve 32 upon sensing of flame at the pilot burner 36. The foregoing components are described as typical of an oven arrangement well known and widely used in LP gas ovens of the type installed in recreational vehicles.

The shut-off and thermostatically controlled valve assembly of the present invention indicated generally at 50 is attached to a suitable mounting bracket 52 provided adjacent the front panel of the casing 12 above the oven chamber. A knob or dial 54 is provided thereon and extends through the front panel of the casing 12 for ready access by the appliance user. The valve assembly 50 is supplied from an LP gas source through conduit 44 typically passing through the rear panel of casing 12 and along the top of the oven wall 14 to the valve assembly 50. The pilot supply conduit 38 for pilot burner 36 extends vertically between the oven wall 14 and outer casing 12, and is connected to one outlet of the valve assembly 50. Similarly, the main burner supply conduit 34 extends vertically between the casing 12 and oven wall 14 and is connected to a separate outlet of the valve assembly 50 as will be hereinafter described in greater detail.

Figure 7:
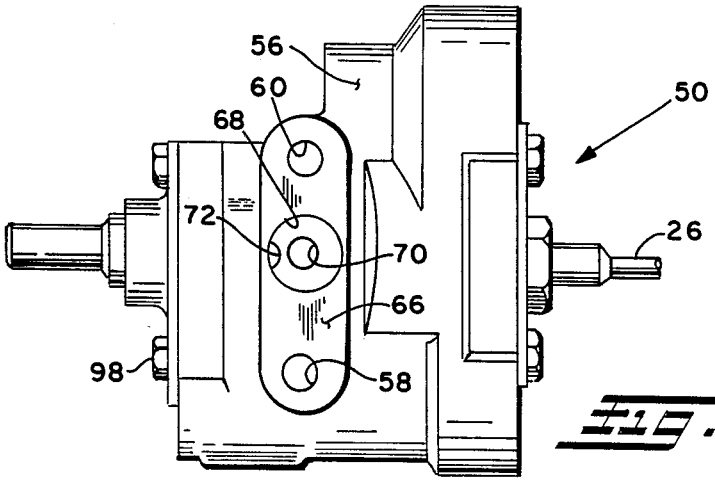

Referring now to FIGS. 2, 3*a*, 3*b* and 7, the valve 50 has a body comprising an integral block 56 with a pair of spaced mounting holes 58, 60, provided laterally therethrough for permitting attachment to the mounting bracket 52 (see FIG. 1) by suitable fasteners such as bolts 62, 64. With reference particularly to FIG. 7, the valve block has on one side thereof a plainer surface 66 which is adapted for having an inlet fitting (not shown) received and sealed thereover as for example by suitable gasketing for connecting the main supply line to the valve block. Surface 66 has formed therein a collector bore 68 which communicates with a main burner passage 70 and a pilot burner inlet passage 72. In the present practice of the invention, a cut-out, (not shown) is provided in the mounting bracket 52 for connection to the inlet connector 68 to permit the inlet fitting to extend therethrough for connection with the supply line 44.

Figure 2:
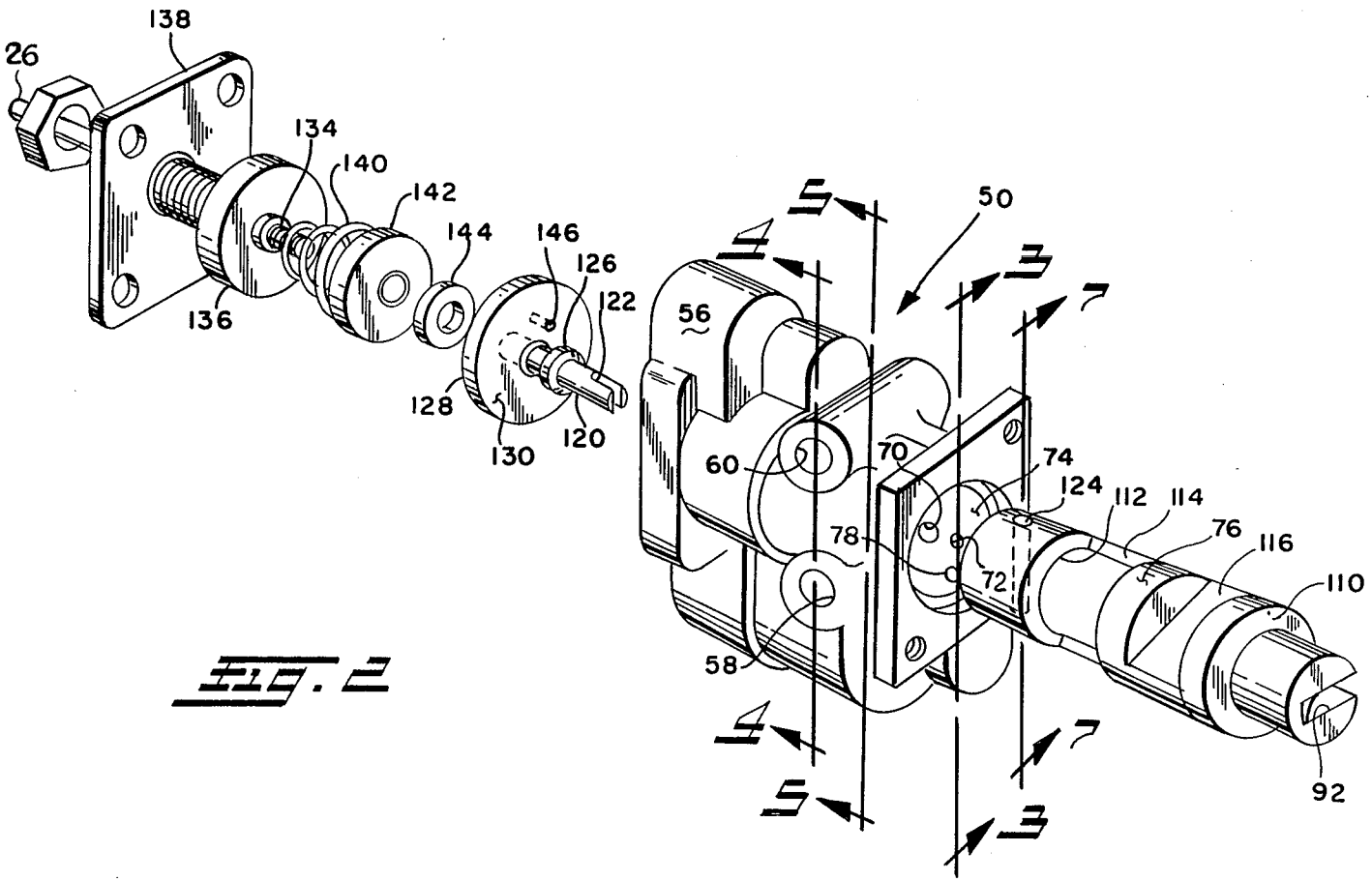
FIG. 2 is an exploded view of the valve assembly of FIG. 1.
Figure 3A:
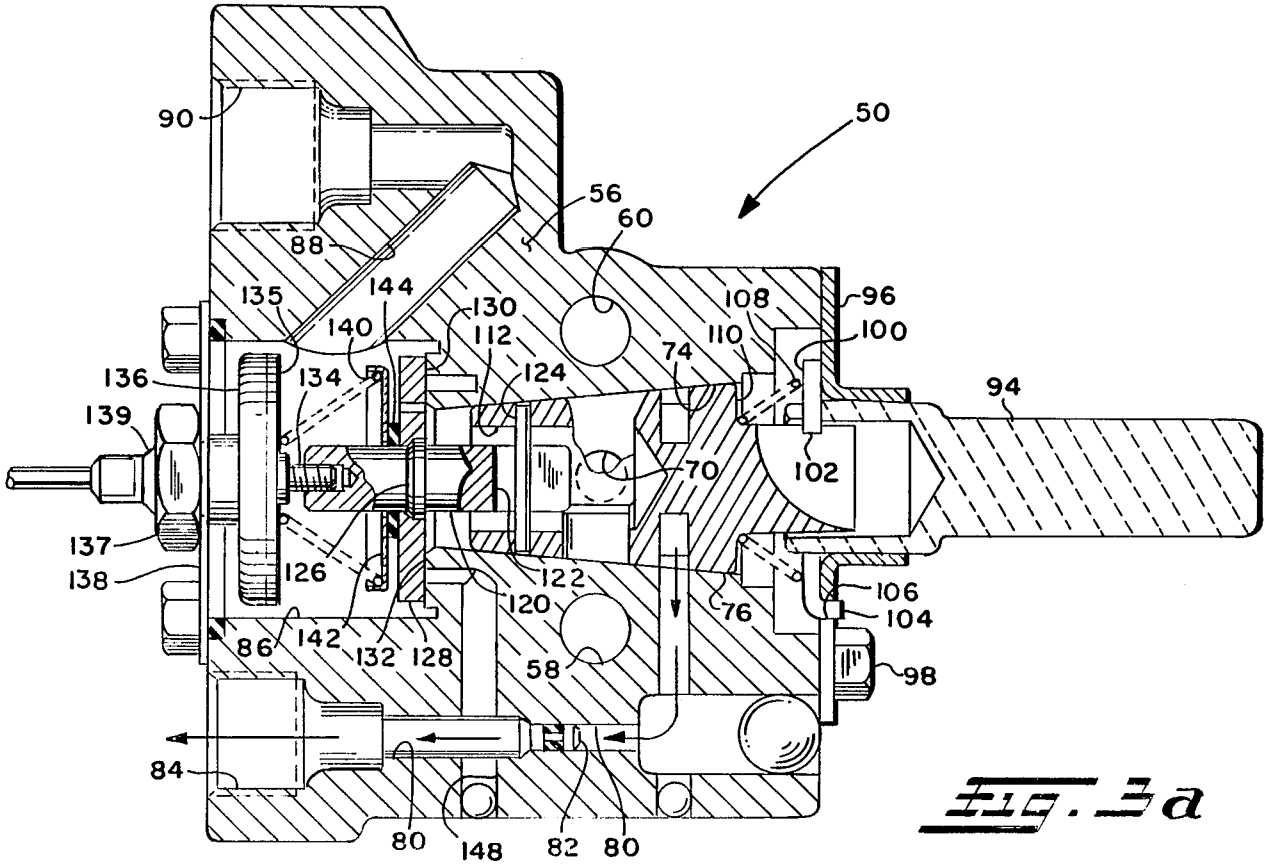
FIG. 3*a* is a section view taken along section-indicating lines 3—3 of FIG. 2 and illustrates the thermostatically controlled valve in the closed position.
Figure 6E:
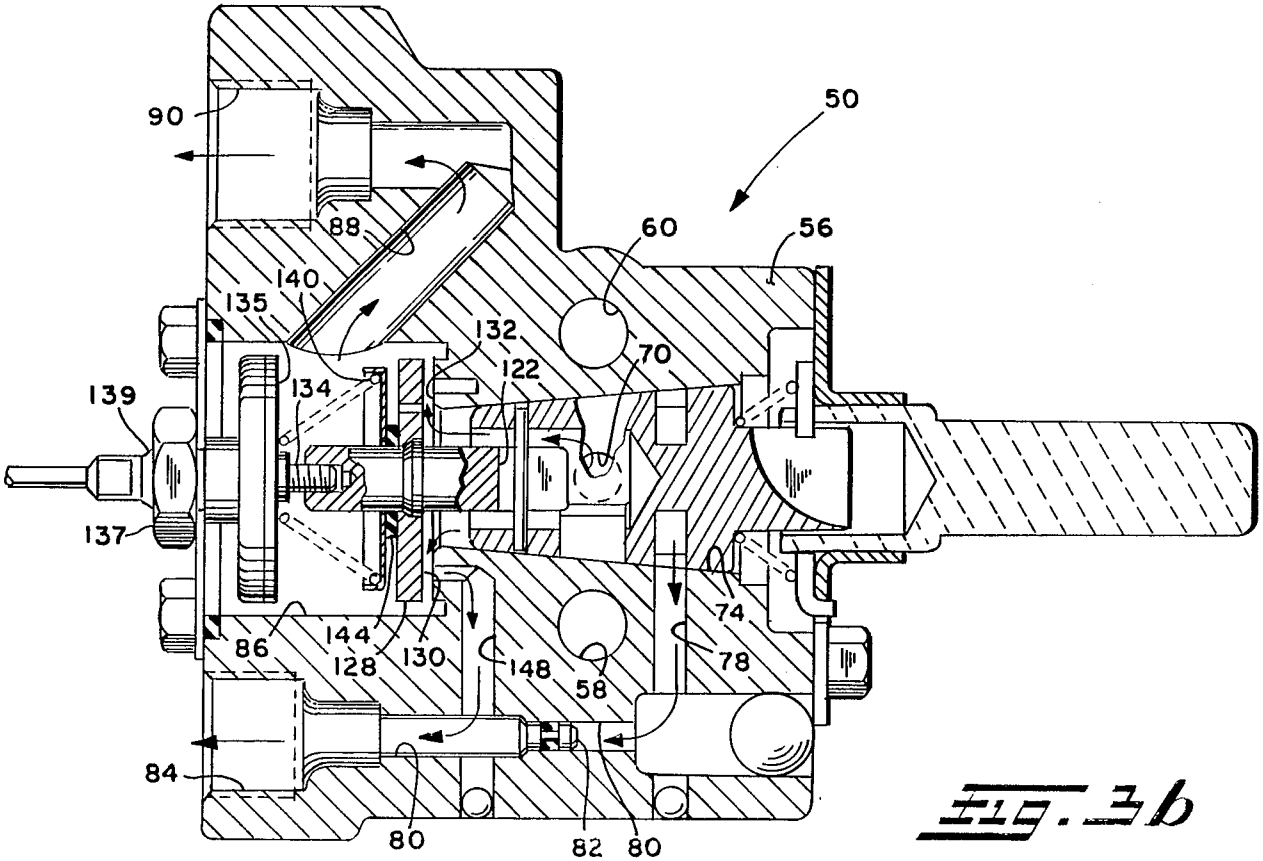
FIG. 6*a* is a view of the user control in the OFF position.
FIG. 6*b* is a view similar to FIG. 6*a* showing the control in the PILOT position.
FIG. 6*c* is a view similar to FIG. 6*a* and shows the control in the ON position; and, FIG. 7 is a view taken along section indicating lines 7—7 in FIG. 2.

Referring particularly to FIGS. 2, 3*a* and 3*b*, the valve block 56 has a tapered valving bore 74 provided therein and which has received therein, a correspondingly tapered valve member 76 for rotation in the bore 74. The valving bore 74 has ported therein and communicates with the main burner passage 70. In axially spaced arrangement from passage 70, bore 74 is ported to pilot burner passage 72. A pilot burner outlet port 78 is provided in bore 74; and, the port 78 is disposed at the same axial station along bore 74 as the pilot port 72; however, port 78 is disposed circumferentially spaced by an amount subtending a central arc of about 60° from the pilot burner inlet port 72.

The pilot burner outlet passage 78 is cross drilled in the block 56 and communicates with a second longitudinally drilled passage 80, having a suitable flow restrictor plug 82 provided therein, and which communicates with pilot burner outlet port 84. Port 84 is preferably threaded for attachment to pilot burner conduit 38 (see FIG. 1) by suitable threaded flared type tube fitting in a manner well known in the art.

Tapered bore 74 communicates with an enlarged diameter cavity 86 provided in the opposite end of valve block 56, which cavity communicates with a main burner outlet passage 88 which communicates with a threaded outlet port 90 provided in the end of the valve block. Port 90 is adapted for threaded connection to burner conduit 34 (see FIG. 1) by any suitable connection, as for example, a threaded fitting for a flared type tube connection well known in the art.

Tapered valve member 76 has a slot 92 provided in the end thereof adapted for rotary driving connection with a knob support shaft 94 journalled for rotation in a flange 96. Flange 96 is retained on the block by fasteners such as screw 98. Knob shaft 94 has a flange 100 attached thereto on the underside of the journalled flange 96; and, the flange 100 has a lug 102 provided thereon which engages slot 92 on the end of valve member 76 for effecting rotation of the valve member with the shaft 94. The flange 100 also has a second lug 104 bent generally at right angles thereto which lug 104 engages in a slot or aperture 106 provided in the flange 96. A conically tapered spring 108 which registers against a shoulder 110 provided on the end of valve member 76 urges lug 104 into slot 106. Thus, in order for the appliance user to effect rotation of the shaft 94, the shaft must be moved axially (leftward in FIG. 3*a* and FIG. 3*b*) to disengage the lug 104 from slot 106 to permit rotation of the shaft and valve member 76.

Valve member 76 has a bore 112 provided in the smaller diameter end of the tapered portion and has a groove or recess 114 formed therein, communicating with the bore 112, for providing a valving surface for closing and opening the inlet passage 70 to the bore 112 in the valving member. A second recess 116 is axially spaced along the valve member 76 from the recess 114, and the recess 116 provides a passage for permitting flow between pilot inlet port 72 and pilot outlet port 78 in the bore 74. The recesses 114 and 116 thus comprise the shut-off portion of the valve assembly for start-up and shut down.

Referring now to FIGS. 4, 5 and 6, the orientation of the surfaces of the recesses 114, 116 are snown for the various positions of the user operated control knob 54.

Figure 4A:
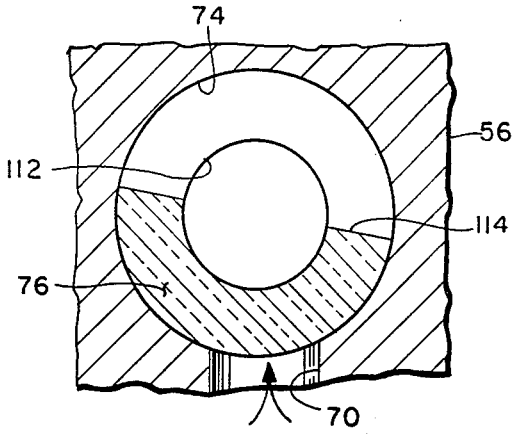
FIG. 4*a* is a section view taken along section indicating lines 4—4 of FIG. 2 and shows the main burner valve of the present position in the OFF position.
Figure 5A:
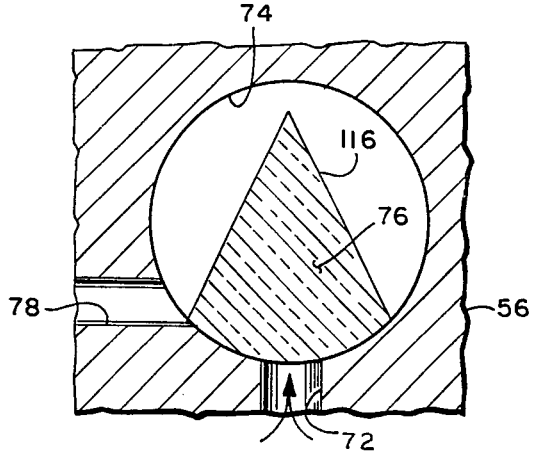
FIG. 5*a* is a section view taken along section indicating lines 5—5 of FIG. 2 and shows the pilot burner valve in the OFF position.
Figure 6A:
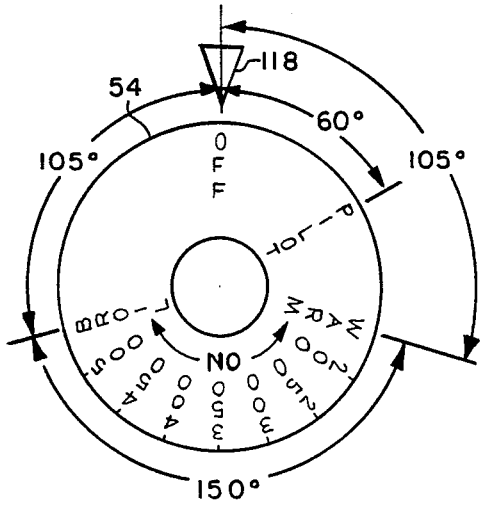

Referring to FIGS. 4*a*, 5*a* and 6*a*, the valve member 76 is illustrated in the OFF position as shown by the printed indicia on knob 54 in FIG. 6*a* being disposed directly opposite the triangular index mark. The index mark provided on the front panel of casing 12 is identified by the heavy black triangle denoted 118 in FIG. 6*a*. With knob 54 in the position shown in FIG. 6*a*, the valve member 76 is in a position such that the surface of the shaft blocks flow from pilot passage 72 to the bore 74; and, thus, fuel gas is prevented from flowing to the pilot outlet passage 78, conduit 38 and pilot burner 40. In the OFF position, the surface of the valve member 76 similarly blocks passage of fuel gas from main burner inlet passage 70 to bore 74 as shown in FIG. 4*a*, with the main valve recess 114 being disposed on the side of the valve member opposite inlet passage 70. With the valve member 76 in the position shown in FIG. 4*a*, fuel gas is prevented from flowing through bore 112 and from communicating with cavity 86, burner outlet passages 88 or conduit 34.

Figure 4B:
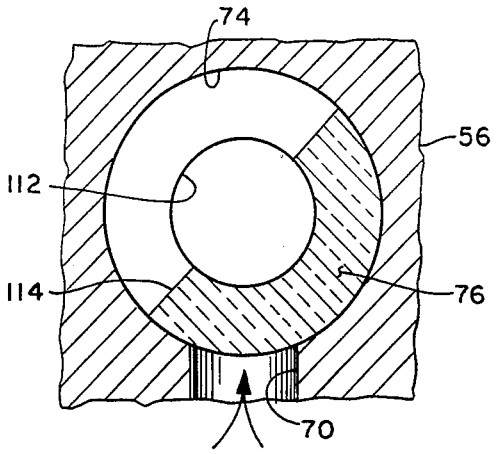
FIG. 4*b* is a view similar to FIG. 4*a* and shows the main burner valve in the PILOT position.
Figure 5B:
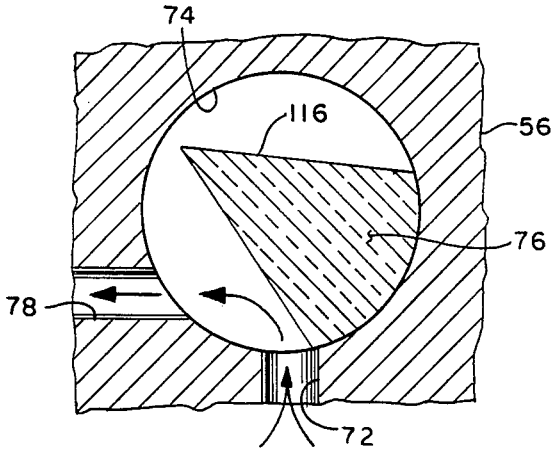
FIG. 5*b* is a view similar to FIG. 5*a* and shows the pilot burner valve in the PILOT position.
Figure 6B:
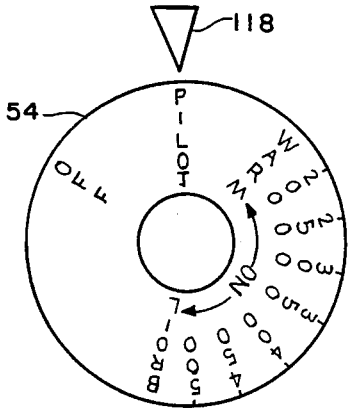

Referring to FIGS. 4*b*, 5*b* and 6*b*, the valve member 76 is shown rotated to a position such that the dial knob 54 has the indicia "PILOT" disposed adjacent index mark 118; and, the valve is rotated to a position as shown in FIG. 4*b* such that the tapered surface of valve member 76 continues to block main burner inlet passage 70 and prevent flow of fuel gas to the conduit 34. In this latter position, the pilot valve recess 116 is rotated to a position as shown in FIG. 5*b*, to permit gas flow from pilot inlet passage 72 through bore 74 and pilot outlet passage 78 to conduit 38 for communicating with the pilot burner 36. Ignition of the pilot burner may then be accomplished, either by manual means, such as striking a match, or by a suitable electric spark ignitor or any other suitable technique well known in the art.

Figure 4C:
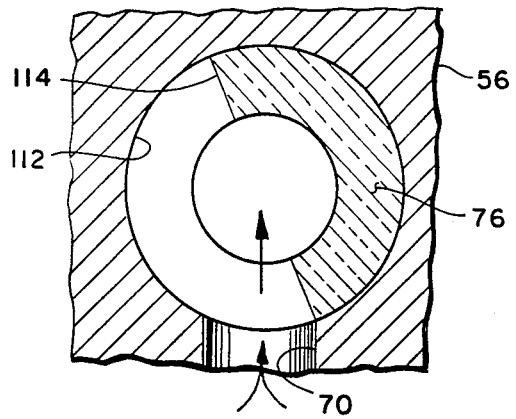
FIG. 4*c* is a view similar to FIG. 4*a* and shows the main burner valve in the ON position.
Figure 5C:
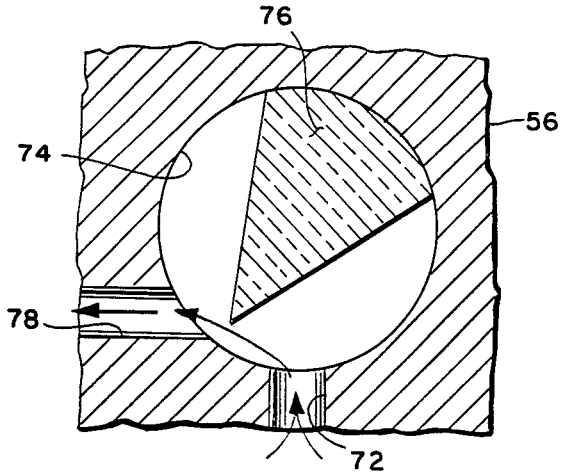
FIG. 5*c* is a view similar to FIG. 5*a* and shows the pilot burner valve in the ON position.
Figure 6C:
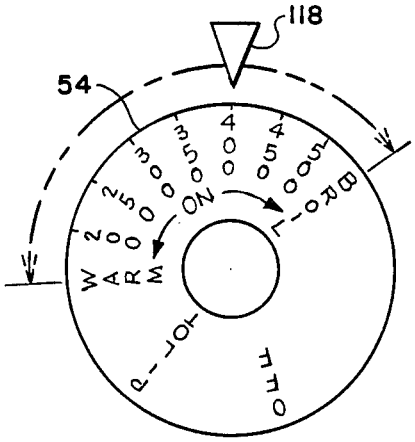

Referring to FIGS. 4*c*, 5*c* and 6*c*, valve member 76 is shown as rotated to a ON mode as shown in FIG. 6*c* by the dashed arc extending on either side of the index mark 118. The ON mode includes the range of positions between the position marked WARM and the position marked BOIL on the dial knob 54 with intermediate positions identified for specific temperature settings of the oven. With the valve member 77 in any of the ON positions, the main burner inlet passage 70, as shown in FIG. 4*c*, communicates with the recess 114 and bore 112 to permit gas flow into cavity 86 and passages 88, 90 and main burner conduit 34 to the ignition valve 32. With reference to FIG. 5*c* fuel gas continues to flow through pilot inlet passage 72, bore 74 and outlet passage 78 to pilot burner conduit 38.

With the dial knob 54 set in any of the positions shown in FIG. 6*c*, and with a standing pilot flame impinging upon the bulb 40, the Mercury in bulb 40 vaporizes and sufficiently expands through tube 42 to cause valve 32 to open and pass fuel gas to the burner assembly 22 and ignition by the flame emanating from pilot burner 36. In the event that the valve 76 is turned to any of the ON positions as shown in FIG. 6*c*, and the pilot burner has not been ignited, valve 32 is designed to remain in the closed position and fuel gas will be prevented from flowing to the burner assembly 22.

Referring to FIGS. 1, 2 and 3, the construction and function of the thermostatic valve portion of the assembly 50 will be described wherein a connecting shaft 120 has a slot 122 provided in one end which engages a cross pin 124 provided through valve member 76 in the region of bore 112; and, the connection is thus in torque transmitting yet axially free sliding engagement. Shaft 122 has provided thereon an annular flange 126 which has registered thereagainst the inside diameter of a poppet 128 having a precision flat face 130 for seating against a corresponding annular flat seat 132 provided in the block 56 at the opening of tapered bore 74 into the cavity 86.

The end of shaft 120 opposite the slot 122 is threadedly received over a post 134 provided on the diaphragm portion 135 of the wall of a fluid filled capsule 136 which is received in the cavity 86 and secured therein by suitable fastener such as nut 137 threaded over a threaded fitting 139 on the capsule and which extends through retaining flange 138.

Capsule 136 has connected thereto one end of the capillary 28 of the oven temperature sensing bulb 24. A conically tapered spring 140 registers against the diaphragm face 135 of capsule 136 and has the opposite end thereof registered in a retaining cup 142 received over shaft 120 and registering against a seal ring 144. Spring 140 urges the seal ring into contact with the poppet 128 thereby urging the face 130 of the poppet into contact with valve seat 132. Poppet 128 has a small bleed passage 146 provided therethrough and located radially inwardly of valve seat 132.

In operation, with the valve knob 54 set in the OFF position, slot 122 permits the spring 140 to close the poppet 130 against valve seat 132. When the valve member 76 and knob 54 are rotated to the ON position, shaft 121 is rotated on threaded post 134 by an amount sufficient to cause the flange 126 to lift the poppet face 130 away from valve seat 132 to the position as shown in FIG. 3*b*, thereby, permitting fuel gas to flow to main burner outlet port 90 and through conduit 34 and valve 32 for ignition of the burner assembly 22 by pilot flame. Upon the temperature in the oven, as sensed by bulb 24, reaching the selected desired temperature, the Mercury vapor in bulb 24 and capillary 28 acts upon the capsule diaphragm 135 to move the threaded post 134 in an amount sufficient to reseat poppet face 130 against the valve seat 132 in the block. Thereafter, the gas in bore 112 of the tapered valve member is restricted to flow through the bleed passage 146 in the poppet and thereby "banks" or reduces the main burner flame to a very small amount. In the event that the temperature in the oven drops below the desired temperature, the cooling of the Mercury vapor in bulb 24 and capsule 136 causes the threaded post 134 to retract and open the poppet 128 to permit reoccurrence of greater flow to the outlet port 90.

An auxiliary passage 148 is cross drilled in the block 56 and communicates with pilot outlet passage 80 and the valve cavity 86. Passage 148 functions to permit additional gas flow to the pilot outlet passage 80 and port 84 when the poppet 128 is in the position lifted from the valve surface 132. The additional flow to the pilot increases the pilot flame from the standing pilot level, with gas applied to the pilot only through restrictor 82, to a much higher flame level, which is necessary to insure opening of ignition valve 32 ignition of the main burner upon opening of the valve 76 to the ON position.

The thermostatic poppet valve 128 is shown in the closed or seated position in FIG. 3*a* and is shown in the ON or lifted position in FIG. 3*b*.

It will be understood that in operation, the sensing bulb 40 disposed adjacent the pilot burner 36 does not open the main burner ignition valve 32 until the bulb 40 senses the presence of the increased pilot flame caused by additional gas flow through the auxillary passage 148 which occurs only upon opening of the poppet valve 128, which is initially effected by turning the valve member 76 to the ON position. Thus, it will be understood that when the main burner is in operation for cooking and the thermostat capsule 136 causes post 134 to close poppet 128, gas flow through passage 148 is blocked and the pilot drops from a burner ignition flame to a smaller standing pilot flame and bulb 40 is cooled sufficient to cause the valve 32 to close and thereby control cycling of the main burner oven temperature about the selected level.

Referring to FIG. 6*a*, the dial/knob and pilot and main burner inlet and outlet ports and valving recess are preferably arranged about valve members such that rotation of valve member 76 by 60° from OFF effects the PILOT mode of operation. Rotation of knob 54 by an arc of 105° to 255° effects the ON mode of operation.

The present invention thus provides a unique and novel combination shut-off and thermostatic control valve assembly for controlling start-up, shut-down and temperature modulation of an LP gas oven. The control valve assembly of the present invention provides separate porting of gas flow to the pilot burner and the main burner in such a manner that when the valve is opened for igniting the pilot burner, fuel is blocked from flowing to the main burner ignition valve to prevent gas flow to the main burner in the event the main burner ignition valve either leaks or has failed in the valve open position. The present invention provides a simple and compact valve assembly in an integral block having separate valving recesses provided on a tapered rotary valve member for controlling valving between separate pilot ports and main burner ports spaced axially. The valve assembly of the present invention thus combines a burner modulating thermostat valve with a valve and provides individual valving thereof upstream of the main burner ignition valve.

Although the present invention has been described with respect to the illustrated embodiments, it will be understood that the invention is capable of modification and variation and it is limited only by the following claims.

I claim:

1. A thermostatically controlled valve assembly for a fuel gas burner comprising:

(a) body means defining an inlet adapted for connection to a source of fuel gas, a valving cavity communicating with said inlet, a pilot burner outlet and a main burner outlet;

(b) selector valve means disposed in said cavity and selectively moveable between an OFF, PILOT and a range of ON positions for selectively blocking and valving fuel gas flow to said outlets;

(c) thermally sensitive means including control valve means disposed in said cavity and operative, in response to changes in a sensed temperature associated with operation of the burner to control fuel gas flow to said main burner when said selector valve means is in the said range of ON positions;

(d) said valve assembly, upon connection of a fuel gas source to said inlet operative with said selector valve means in (i) said OFF position to direct fuel gas to neither of said pilot port or main port, (ii) said PILOT position to direct fuel gas only to said pilot port, (iii) said ON position to direct fuel gas to said pilot port and said main burner port;

(e) said thermally sensitive means operative in response to sensing a preselected temperature condition to move said control valve means from a first to a second position, said control valve means operative in said second position to reduce flow to said main burner port to a minor fraction of the flow when said control valve means is in said first position; and, (f) said selector valve means operative when in the "ON" position to be movable within limits to a range of positions for selecting the sensed temperature at which said thermally sensitive means moves said control valve means to said second axial position.

2. The thermostatically controlled valve assembly defined in claim 1, wherein said selector valve means includes a first rotatable member and said control valve means includes a second rotatable member disposed for rotation about a common axis and having a torque transmitting axial lost-motion interconnection therebetween.

3. The valve assembly defined in claim 1 wherein said valve means defined includes an axially tapered member having a plurality of axially spaced recesses there, and said body means has a tapered bore with said tapered member rotatably received therein =, said body means having a first passage communicating said inlet with one of said recesses when said valve means is rotated to said ON position, said body means having a pair of passages disposed about said bore in circumferentially spaced arrangement with one of said pair of passages connected to said inlet and the second of said pair connected to said pilot flow port, and a second one of said plurality of recesses interconnects said pair of passages when said valve means is in the PILOT and ON position.

4. The valve assembly defined in claim 1, wherein said valve means includes an axially tapered member rotatably received in a tapered bore in said housing means and defining first and second valving surfaces and an axially movable member rotatable with said tapered member and in axial lost-motion connection therewith and defining in cooperation with said cavity, third valving surfaces opening and closing upon axial movement of said member for substantially reducing flow to said main burner port.

5. The valve assembly defined in claim 1, wherein said valve means includes a first valving surface thereon defining in said PILOT and ON positions, a first passage connecting said inlet with said pilot burner port and a second valving surface thereon defining in said ON position a second passage connecting said inlet with said main burner port.

6. A thermostatically controlled valve assembly for a fuel gas burner comprising:

(a) body means defining a valving cavity, a fuel gas inlet, a pilot burner outlet port and a main burner outlet port;

(b) selector valve means disposed in said cavity and operative for selective rotation between an OFF, PILOT and a range of ON valving positions, said valving means operable upon connection of a source of fuel gas to said body means inlet;

(i) in said OFF position to block all fuel gas flow to said pilot burner port and block all fuel gas flow to said main burner port, (ii) in said PILOT position to permit fuel gas flow only to said pilot burner port;

(iii) in said ON position to permit fuel gas flow to said pilot burner port and said main burner port;

(c) thermally responsive means including operable when said selector valve means is in said ON position to move to a position substantially reducing fuel gas flow to said main burner port in response to sensing a preselected temperature condition in the region to be heated by said burner.

7. The valve assembly defined in claimed 6, wherein said movable valve means includes an axially tapered member selectively rotatable between said OFF, PILOT and a range of ON positions.

8. The valve assembly defined in claim 6, wherein said thermally responsive means includes a valve seat and a second valve member movable with respect to said valve seat, and means defining a.bleed passage to permit said substantially reduced fuel gas flow to said main burner when said second valve member is seated against said valve seat.

9. The valve assembly defined in claim 6, wherein said selector valve means includes an axially tapered member received in a correspondingly tapered bore in said body means.

10. The valve assembly defined in claim 6, wherein said selector valve means includes an axially tapered member received in a correspondingly tapered bore in said housing means communicating with said valving cavity; and, (a) said tapered member has plural axially spaced recesses thereon cooperating with a plurality of spaced ports in said bore for providing valving between said inlet and said pilot and main burner outlet ports.

11. The valve assembly defined in claim 6, wherein said housing means comprises an integrally formed valve block with said valve means assembled into said cavity from one end of said block, with said thermally responsive means assembled into said cavity from an end of said block opposite said one end, with said valve means and said thermally responsive means each secured therein by cover means secured to said block.

12. The valve assembly defined in claim 6, wherein said thermally responsive means includes a valve seat and flow reducing valve means disposed in said cavity, said flow reducing valve means operable, when said selector valve means is in the OPEN position, to move between a position spaced from said valve seat to a position contacting said valve seat thereby substantially reducing fuel gas flow to said main burner.

13. The valve assembly defined in claim 6, wherein said selector valve means is selectively rotatable between said OFF, PILOT and range of ON positions and said thermally responsive means is connected thereto by means operative for transmitting said selective rotation for adjustment and absorbing therebetween as lot motion said movement of said thermally responsive means responsive to a sensed condition.

* * * * *